US005732861A

United States Patent [19]

Jakobson

[11] Patent Number: 5,732,861

[45] Date of Patent: Mar. 31, 1998

[54] BABY CARRYING HARNESS AND CLASP MEANS THEREFOR

[75] Inventor: Björn Jakobson, Täby, Sweden

[73] Assignee: Baby Björn AB, Täby, Sweden

[21] Appl. No.: 669,735

[22] Filed: Jun. 26, 1996

[30] Foreign Application Priority Data

Jul. 3, 1995 [SE] Sweden ..... 9502414-7

[51] Int. Cl.[6] ..... A61G 1/00

[52] U.S. Cl. ..... 224/160; 224/158; 24/589

[58] Field of Search ..... 224/158, 159, 224/160, 161; 24/589

[56] References Cited

U.S. PATENT DOCUMENTS

| | | | |
|---|---|---|---|
| 831,402 | 9/1906 | Austin | 24/589 |
| 2,554,340 | 5/1951 | Maxwell | 224/160 |
| 3,229,873 | 1/1966 | Hershman | 224/160 |
| 4,139,131 | 2/1979 | Hathaway | 224/160 |
| 4,149,687 | 4/1979 | Nunemacher | 224/159 |
| 4,402,440 | 9/1983 | Purtzer et al. | 224/160 |
| 4,646,400 | 3/1987 | Tanaka . | |
| 4,757,579 | 7/1988 | Nishino et al. . | |
| 4,903,873 | 2/1990 | Poole et al. | 224/160 |
| 5,086,548 | 2/1992 | Tanaka et al. . | |
| 5,178,309 | 1/1993 | Bicheler et al. | 224/160 |
| 5,246,152 | 9/1993 | Dotseth | 224/159 |
| 5,490,620 | 2/1996 | Bergqvist | 224/160 |

FOREIGN PATENT DOCUMENTS

| | | | |
|---|---|---|---|
| 0 323 112 | 7/1989 | European Pat. Off. . | |
| 1545820 | 11/1968 | France | 224/160 |
| 2481093 | 10/1981 | France | 224/160 |
| 92/12656 | 8/1992 | WIPO . | |
| 92/16130 | 10/1992 | WIPO | 224/160 |

*Primary Examiner*—Henry J. Recla
*Assistant Examiner*—Gregory M. Vidovich
*Attorney, Agent, or Firm*—Evenson, McKeown, Edwards & Lenahan, PLLC

[57] ABSTRACT

A clasp includes a bar lock and two insert locks arranged adjacent thereto. The bar lock includes upper and lower generally horizontal frame members and two mutually parallel and generally vertical side frame members, and a bar having ends which are shape-bound connected for movement of the bar along respective side members. Each of the insert locks includes an insert tongue and a tongue-receiving sleeve having a through-penetrating opening in one main wall of the sleeve. The sleeves are attached to the upper of the two generally horizontal frame members. The insertion directions of the sleeves converge towards the longitudinal center region of the upper bar-lock frame part. The clasp finds use in enabling adjustments to be made to a lower belt-like end-part of a carrier piece of a baby's carrier which comprises generally two closed strap loops which are mutually fastened on the rear side of the carrying person. The front side of the strap loops carry the latching tongues of the insert locks. The two side-edge parts of the carrier piece are connected to upper fastener points on respective loops by means of releasible connections.

8 Claims, 3 Drawing Sheets

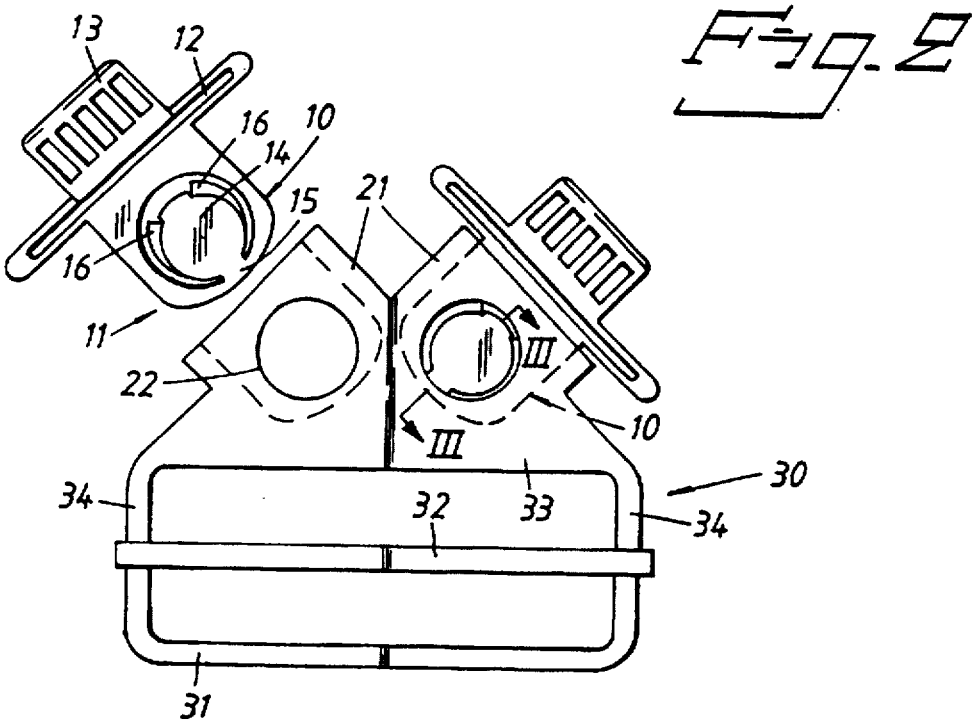
Fig. 2
Fig. 3
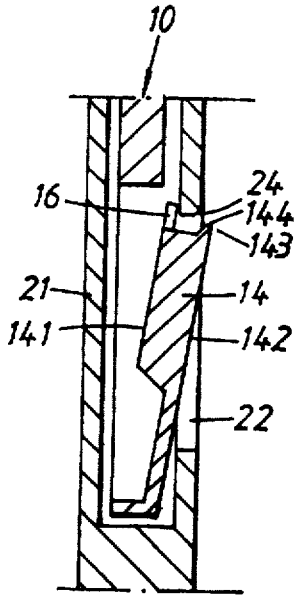

BABY CARRYING HARNESS AND CLASP MEANS THEREFOR

BACKGROUND OF THE INVENTION

1. Field of the Invention

This invention relates to a baby or infant carrying harness, hereinafter referred to as a baby carrier, and to a clasp.

2. Description of Related Art

International Publication WO-92/12656 discloses a baby carrier which includes two closed strap loops which are mutually connected on the rear side of the carrying person. The loops are detachably connected on the carrying person's front side to top and bottom attachment points on a carrier piece which forms a carrier pouch on the front side of the baby carrier. The carrier piece is provided with two longitudinally spaced attachment points at the bottom of the piece, so as to enable the pouch to be adjusted to two predetermined different depths.

The connections taught by this publication have the form of a metal ring, which is connected to one part, and a duffel fastener, which is connected to the other part via an anchoring strap. The anchoring strap also has two mutually coactable press-button coupling members. Fastener means of this kind are highly expensive, due partly to the cost of the individual components, and partly due to the cost of securing the components to the baby carrier. Furthermore, the pouch can only be adjusted to two different depths. There is also a tendency for the fastener devices (the rings/duffel fasteners) to be clamped or squeezed against the carrying person's chest and cause discomfort.

SUMMARY OF THE INVENTION

Accordingly, it is an object of the present invention to replace, in baby carriers of this kind, the fastener devices that are located between the bottom part of the carrier piece and the strap loops with a clasp means that can be produced at relatively low costs, which enables the depth of the pouch to be adjusted continuously, and which has a construction that reduces the risk of discomfort due to clamping or squeezing.

The object is achieved according to the present invention.

Because of the inventive design of the clasp means, the clasp means can be conveniently placed centrally on the chest of the carrying person, immediately beneath the rib cage/breastbone, by virtue of the generally triangular shape of the clasp, which enables the clasp to fit snugly in the region beneath the breastbone/rib cage. The risk of the clasp being squeezed against the chest and therewith causing discomfort can be reduced by making the clasp thin and giving the clasp a uniform thickness and a slight concave arched shape on the side thereof proximal to the carrying person's body when the carrier is worn. A clasp of this design is well-suited for use by a carrying person whose stomach inclines naturally downwards and inwards centrally from the breastbone/rib cage region.

Because the clasp comprises, in principle, a clasp body which is provided with three locks, namely two snap-in insert locks and a so-called bar lock which affords adjustable length connection to the lower strap part of the baby carrier, the clasp means obtains a particularly compact design while, at the same time, the snap-in insertion locks are well protected against an intentional release while still being easily reached when wishing to release the same.

The particular construction of the insert locks affords excellent high bearing safety. The general construction of the baby carrier also counteracts the risk of the baby carrier letting the baby falling to the floor should one insert lock be unintentionally released, because the closed strap loop associated with this lock will then tend to be drawn firmly up over the shoulder region of the carrying person, whereas the other closed strap loop will tend to slide from the other shoulder region of said carrying person under the influence of the baby's weight.

The bar-type lock enables the lower strap-like part of the carrier pouch to be adjusted continuously to a desired length and thus enables the effective depth of the carrier pouch to be adjusted continuously. In order to avoid the risk of the lower strap-like part of the carrier piece being released from the bar lock, the end of the strap-like piece is connected to the clasp body and then to the lower generally horizontal frame element of the bar lock. The frame element extends generally parallel to the bar.

The insert locks are preferably placed on the upper side of the bar lock and directed upwardly/obliquely outwards so as to diverge from one another for connection to a respective closed strap loop on the baby carrier.

Located between each strap loop and respective adjacent upper side-edge regions of the carrier piece is a detachable connection, for instance a connection of the type disclosed in WO 92/12656.

According to one preferred embodiment of the invention, the clasp insert locks are constructed such that the forwardly rounded flat insert tongue has a centrally located aperture which has located therein a latching tongue which is connected to the insert tongue solely at its forward end as seen in the insert direction. The latching tongue is slightly oblique to the plane of the insert tongue.

The insert sleeve corresponding to the tongue includes, in one main wall, an opening in which the latching tongue is exposed. The latching tongue is able to spring out so that its free edge part will be aligned with the adjacent opening wall edge in the opening in the sleeve wall. Retraction or withdrawal of the latching tongue will be prevented until the latching tongue is pressed manually inwardly of the main wall surfaces of the insert tongue, for instance, with the aid of a finger. According to the invention, the insert lock has been further developed by providing the latching tongue with a latching lip which prevents the insert tongue from being swung out through the opening as a result of contact with the inside of the main lock wall adjacent the edge of the opening. The rear edge part of the latching tongue is provided, on the surface thereof exposed in the opening in the latching tongue, with a shoulder which, when the insert tongue is subjected to a withdrawal load, hooks over the outer opening edge of the sleeve. The latching tongue is locked by virtue of the flange and the shoulder gripping over the inner and outer edge of the sleeve opening.

The clasp is preferably injection-moulded from plastic material, and the insert locks are placed generally perpendicular to one another and at an angle of 45° to a clasp symmetry plane. The insert locks are preferably placed as close together as possible, and as close as possible to the bar lock.

The insert locks may take a generally flat shape so that the two symmetrical halves of the clasp are mutually spaced apart at an angle of 20° around the intersection of the symmetry plane with the clasp. This angling configuration changes to a generally rounded shape in the clasp bar lock so that the bar may follow an arcuate path, as can the bar-lock frame parts that extend parallel with the bar.

BRIEF DESCRIPTION OF THE DRAWINGS

The invention will now be described in more detail with reference to an exemplifying embodiment thereof and also with reference to the accompanying drawings, in which

FIG. 2 illustrates schematically a clasp for use with the baby carrier shown in FIG. 1;

FIG. 3 is a schematic section view taken on the line III—III in FIG. 2;

DESCRIPTION OF THE PREFERRED EMBODIMENT

Figure 1:
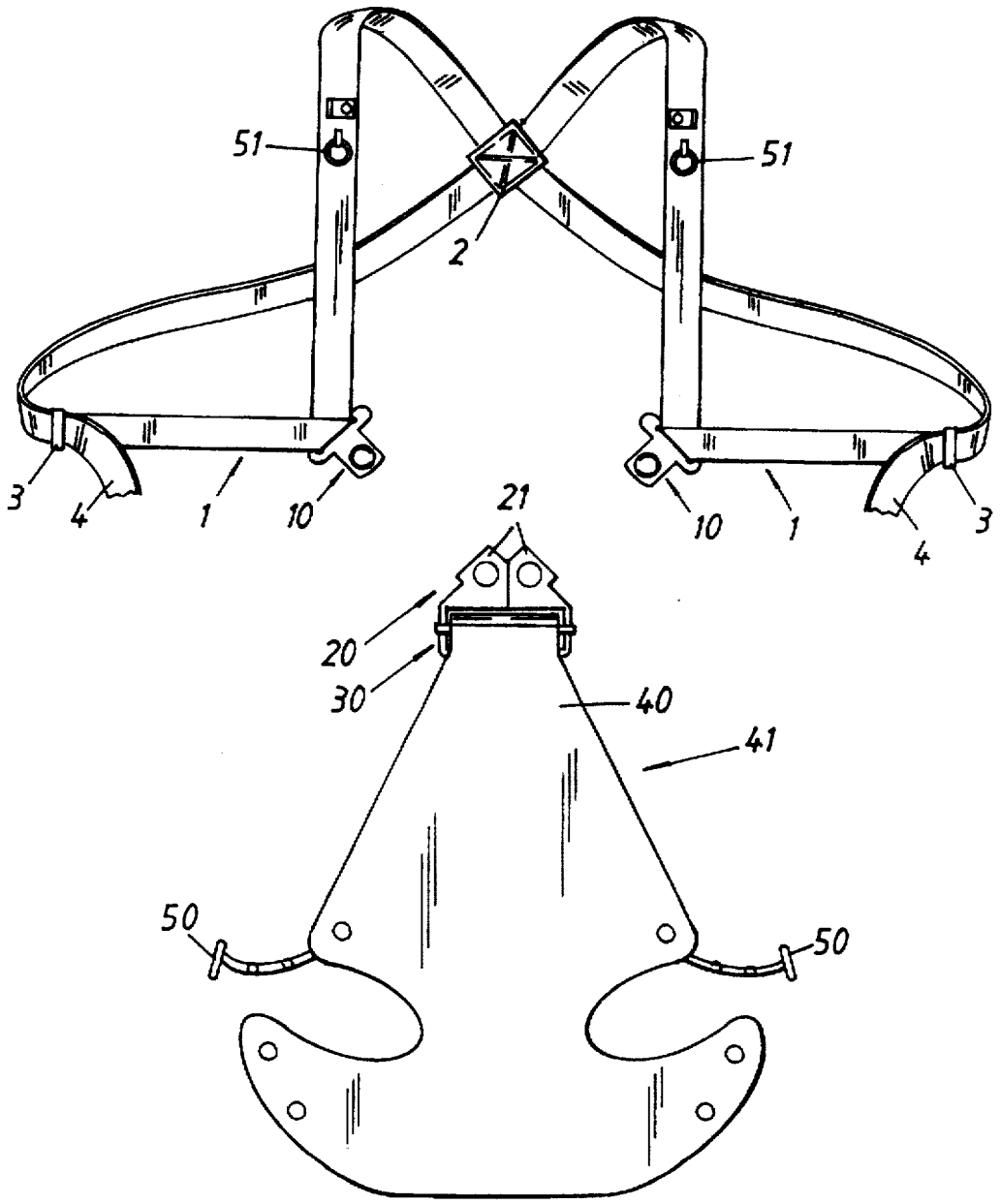
FIG. 1 illustrates an inventive baby carrier.
Figure 4:
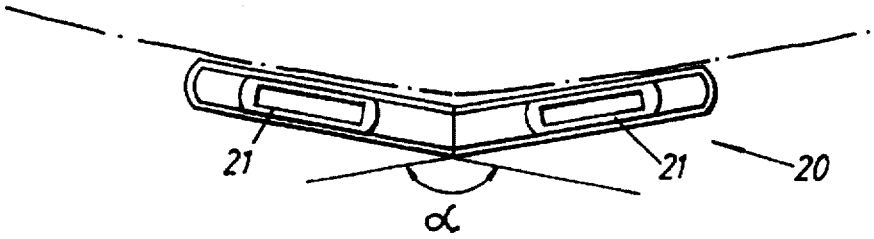
FIG. 4 illustrates the baby carrier clasp schematically from above.

The baby carrier illustrated in FIG. 1 includes two closed strap loops 1 which are connected together on the rear side of the carrying person by means of a fastener means 2. In the illustrated case, the strap loops 1 may be formed by a single strap loop which has been twisted into a figure-eight configuration and connected to the fastener 2 at the point of loop intersection.

Each loop 1 is provided with a conventional adjusting buckle 3, wherein a strap end 4 extends forwardly and downwardly from the region of the carrying person's waist in his/her hip region to enable the size of respective loops 1 to be reduced by pulling forwards on the strap ends 4.

Figure 5:
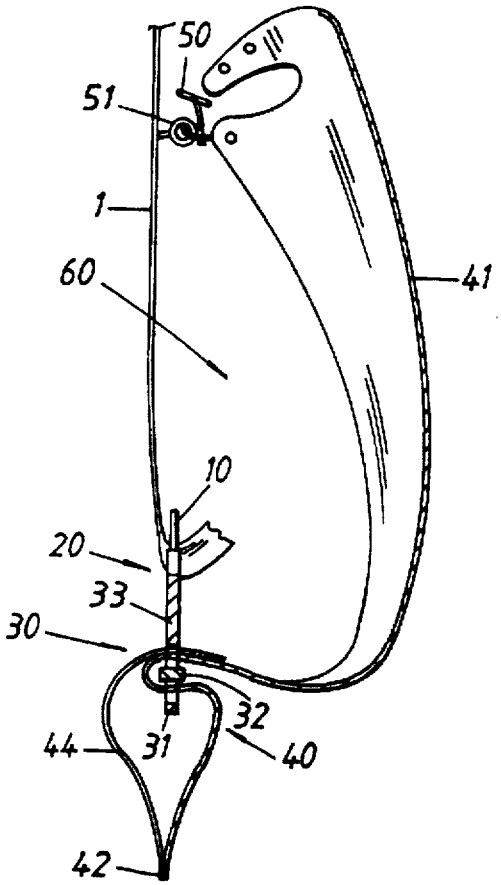
FIG. 5 is a sectioned vertical view of the baby carrier and baby carrier clasp as worn by a carrying person in which the section is defined by the symmetry plane of the carrying person.

Each of the loops 1 has an insert tongue 10 for releasable attachment to a clasp 20 which is intended to be placed on the front of the carrying person, against the wall of the stomach immediately beneath the sternum/rib cage. The generally triangular clasp 20 has sleeves 21 for receiving respective tongues 10. Provided on the lower part of the clasp is a bar lock 30 which enables the length of the "lower" strap-like end-part 40 of a carrier piece 41 to be adjusted lengthwise. The carrier piece 41 carries on each side of its other end a respective fastener means 50 which can be releasably connected to corresponding fastener means 51 on the front side of the carrying person in an upper chest region of the strap loops, so that the carrier piece 41 will thus form a carrier pouch 60 as illustrated schematically in FIG. 5. The strap part 40 extends outwardly and inwardly through an upper opening or slot defined in the bar lock between the upper bar-lock member 33 and the bar 32, and from there extends inwardly and outwardly through the opening or slot defined between the bar 32 and the lower frame member 31. Referring to FIG. 5, it will be seen that the weight of a baby on the supporting pouch formed by the carrier piece 41 will cause the strap part 40 of the carrier piece 41 to lock in the bar lock. It will also be seen that the effective depth of the pouch 60 can be easily adjusted by adjusting the free length of the part 40 from the bar lock 30. Provided on the inside of the strap part 40 is a strap 44 which extends in the longitudinal direction of the strap part 40. The lower end of the strap 44 is fastened to the free end-part 42 of the strap part 40 and its other end is fastened to opposite ends of said strap part 40. The strap 44 and the strap-part 40 form a loop which embraces the lower bar-lock member 31, such as to prevent the strap part 40 from leaving the bar lock. The ends of the strap 44 are preferably sewn to the strap part 40, wherein the strap 44 and the strap 40 have generally equal lengths between their respective fastening points. The strap 44 is preferably placed centrally on the strap part 40 and may be much narrower than said strap part.

Referring now to FIGS. 2 and 3, it will be seen that the sleeves 21 are placed as close together as possible and as close as possible to the frame 33 of the bar lock 30. The front end 11 of each tongue 10 is inserted into its associated sleeve 21. The rear parts of the tongues have loop-receiving slots 12 and a sew-on grids 13. The strap parts on each side of a slot 12 are laid flat against each other with the grid 13 placed therebetween, whereafter the straps and the grid are sewn together. Because the grid has the form of a frame with inner parallel posts which extend in the tongue insertion direction and transversely to the direction of the holding seams, stable fixation of the tongue 10 to the loop is ensured with negligible risk of damaging the sewing needle in the course of sewing; the posts in the grid may be extremely narrow, for instance 1 mm, and spaced far apart, e.g. 4 mm, and may also have a length of about 1 cm for instance, so as to reduce the precision with which the seams need to be positioned. The tongue is provided centrally with a latching tongue 14 which is connected to the front part 11 of the tongue 10 via a bridge 15, whereas the remainder of the latching tongue 14 is free from the insert tongue 10, so as to enable the latching tongue 14 to be swung about the bridge 15 into and out of the plane defined by the insert tongue.

As will be seen from FIG. 3, the latching tongue 14 has a normal position which is angled outwards from the plane of the tongue 10. The sleeve 21 is provided on its exposed side with an opening 22 which is slightly larger than the latching tongue 14, such that the tongue 14 will spring out through the opening 22.

The latching tongue 14 has a thin lip 16 which connects with the rear surface 141 of the tongue 14, and which extends behind the edge of the opening 22 when the tongue 10 is inserted into the sleeve 21 and the latching tongue 14 is latched against the edge of the opening 22. The edge region 143 of the latching tongue 14 is diametrically opposed to the bridge 15 and the outside 142 of the tongue 14 has a wedge-shaped edge part 144 that can pass the edge of the opening and which is located outside the outer edge-surface 24 of the opening 22. When the tongue 10 is subjected to a pulling force in the longitudinal direction of the insert lock, the outer edge-surface 24, of the opening 22 will thus be received between the edge-part 143 and the lip 16, at the same time as the tongue 10 is guided between the two mutually opposing main walls of the sleeve. This enables the latching tongue 14 to be prevented from withdrawing into the sleeve interior or out through the opening 22 in the event of a strong pulling force.

The opening 22 is sufficiently large for a carrying person to finger-actuate the latching tongue 14 so as to push said tongue resiliently inwardly of the inner surface of the sleeve wall in which the opening 22 is provided, whereafter the tongue 10 can easily be drawn back again.

In addition to the frame parts 31, 33, the bar lock 30 typically includes side frame-parts 34 which form guides around which the eye-shaped end-parts of the bar 32 engage.

The clasp illustrated in FIG. 2 has a generally flat shape, although it is preferably angled slightly around an axis forming the intersection line between the plane of FIG. 2 and the symmetry plane of the clasp shown in said Figure, such that the angle $\alpha$ between the two symmetry halves is about 160°.

In one embodiment of the invention, the bar lock has a width of about 10 cm and the upper part of the clasp including the insert locks has a generally triangular shape, wherein the two smaller sides define an angle of about 45° to the upper frame part 33 of the bar lock 30. The concave side of the clasp is intended to lie against the carrying person's body in the upper part of the stomach, immediately beneath the rib cage/breastbone, wherein the clasp affords good comfort even for carrying persons whose upper body shape and stomach profile decrease in a direction downwardly from the breastbone level, such as small and/or slender women, particularly women that have a slim waistline.

FIG. 1 can be considered to show the baby carrier with the insert tongues 10 separated from their respective sleeves 21 in the clasp 20, with the sleeves 21 being turned generally upwards and the bar lock 30 turned downwards, wherein the carrier piece 41 is shown hanging from the bar lock with the fastener devices 50 released from their counterparts 51 on the strap loops 1.

An important feature of the clasp is that it permits the tongues to be connected securely, i.e. with the strap loops close together on the carrying person's chest, and enables the baby to be held more firmly. Another important feature is that the latching locks are reliable and yet easy to reach and release. The bar lock enables the size of the pouch to be adjusted, wherein the belt still ensures positive attachment of the strap part 40 to the clasp.

I claim:

1. A baby carrier comprising:

two closed strap loops which are mutually connected at a point, the strap loops adapted to extend around respective shoulder regions of a user such that the point is located on a rear side of the user, a carrier piece which is connected to the strap loops both at an end part of the carrier piece and at laterally spaced sides of the carrier piece so as to form a baby supporting pouch, a pair of insert tongues secured to said strap loops, releasable fasteners providing connections between the strap loops and the laterally spaced sides of the carrier piece which, when released, enable the carrier piece to be dropped down fully around its end part, and a clasp secured to said end part of said carrier piece and including sleeves for respectively receiving said insert tongues so that said insert tongues are releasably interlocked with said clasp and a bar lock by which a free length of the end part of the carrier piece is adjustable.

2. A baby carrier according to claim 1, wherein the insert tongues are inserted into said sleeves in insertion directions which form a right angle and wherein the sleeves are placed closely adjacent to an upper frame element defining a portion of the bar lock.

3. A baby carrier according to claim 1, wherein each of the insert tongues has a latching tongue which is adapted to spring out into engagement with an edge of an opening that penetrates through one main wall of one of the sleeves when the insert tongue is fully inserted into said one of the sleeves.

4. A baby carrier according to claim 3, wherein a rearwardly facing end-part of the latching tongue has a lip which is engageable with the one main wall to prevent the latching tongue from protruding out through the opening and the latching tongue has, on said rearwardly facing end-part, a flange which is intended to prevent the latching tongue from being moved to a position within the one main wall when the insert tongue is subjected to a pulling force by one of said strap loops.

5. A baby carrier according to claim 1, wherein the bar lock includes an upper frame member, a lower generally horizontal frame member, two mutually parallel and generally vertical frame side members, and a bar having ends which are connected to said side members for movement up and down.

6. A baby carrier according to claim 5, wherein the clasp has a central symmetry plane which extends perpendicularly to the bar of said bar lock and between the sleeves of said clasp and wherein halves of the clasp defined by said central symmetry plane are generally flat.

7. A baby carrier according to claim 6, wherein the halves mutually intersect at an angle of about 20° and the sleeves are located on a convex side of the clasp.

8. A baby carrier according to claim 5, and further comprising a safety strap having ends attached to said carrier piece and defining, together with said end part of said carrier piece, a loop which surrounds said lower generally horizontal frame member.

* * * * *